US005809984A

United States Patent [19]

Johnson

[11] Patent Number: 5,809,984

[45] Date of Patent: Sep. 22, 1998

[54] ARCHERY BOW CABLE ADJUSTER

[75] Inventor: Steven C. Johnson, Harrisburg, Oreg.

[73] Assignee: Center Spot, Inc., Harrisburg, Oreg.

[21] Appl. No.: 960,274

[22] Filed: Oct. 29, 1997

[51] Int. Cl.[6] ..... F41B 5/14

[52] U.S. Cl. ..... 124/86; 124/25.6

[58] Field of Search ..... 124/25.6, 86

[56] References Cited

U.S. PATENT DOCUMENTS

| | | | |
|---|---|---|---|
| 4,733,648 | 3/1988 | Martin | 124/86 |
| 4,781,167 | 11/1988 | Martin | 124/25.6 |
| 5,381,777 | 1/1995 | Mitchell et al. | 124/25.6 |
| 5,606,963 | 3/1997 | Wenzel et al. | 124/86 |

*Primary Examiner*—John A. Ricci
*Attorney, Agent, or Firm*—Chernoff, Vilhauer, McClung & Stenzel

[57] ABSTRACT

A cable adjuster for individually adjusting the cable ends of a split cable on a compound archery bow has a body with a medial slot located in it which fits over the end of the pin which journal the bow cams. The slot is configured so that the body can rotate on the pin and be slid toward and away from the center of the bow. A retainer secures the body rotatably on the pin. A button attached to the body releasably engages a loop located at the cable ends. A notch is located between the body and the button to seat the cable loop on the device. The button and notch are angled with respect to the body such that when a force which is applied to the cable, the elongate axis of the body remains normal to the axis of the pin so that the body can rotate on the pin without binding. A set screw extends through the top end of the body into the slot where it contacts the top of the pin when force is applied to the cable. By screwing the set screw into the body, the cable is effectively shortened and by screwing the set screw out of the body, the cable is effectively lengthened. One cable adjuster is located on each side of each bow limb.

4 Claims, 2 Drawing Sheets

Fig. 1
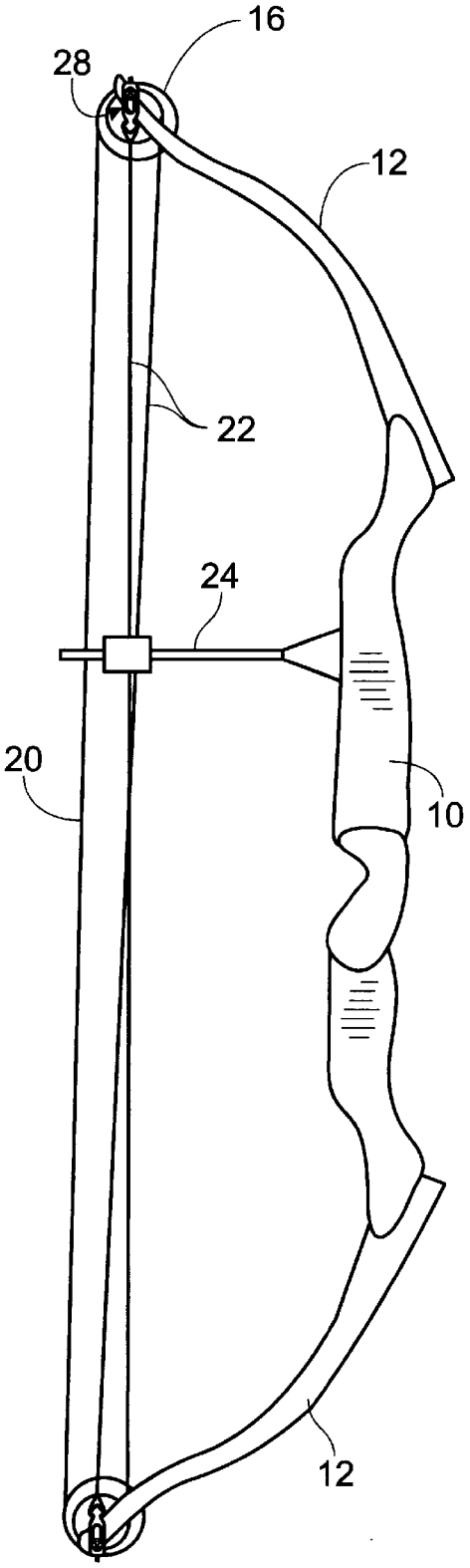
Fig. 5
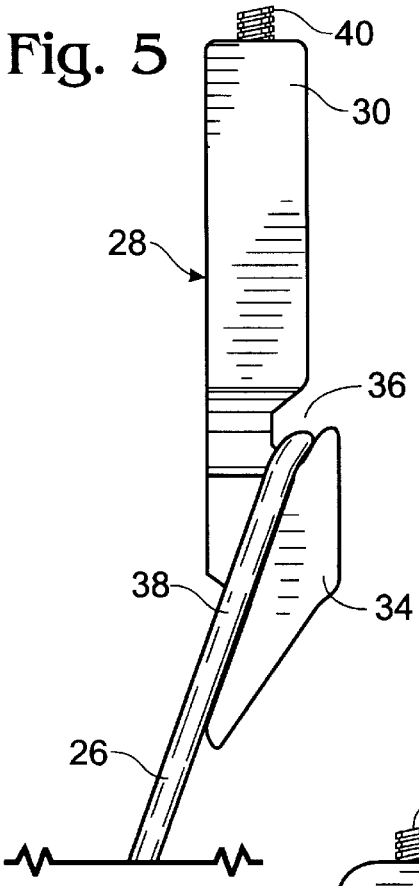
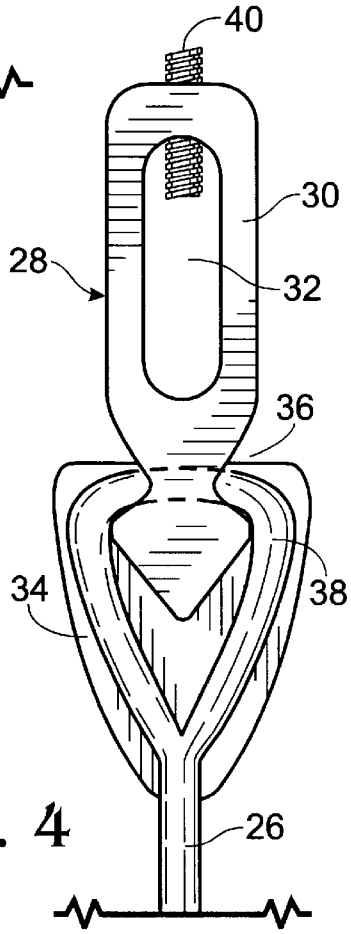
Fig. 4

Fig. 2
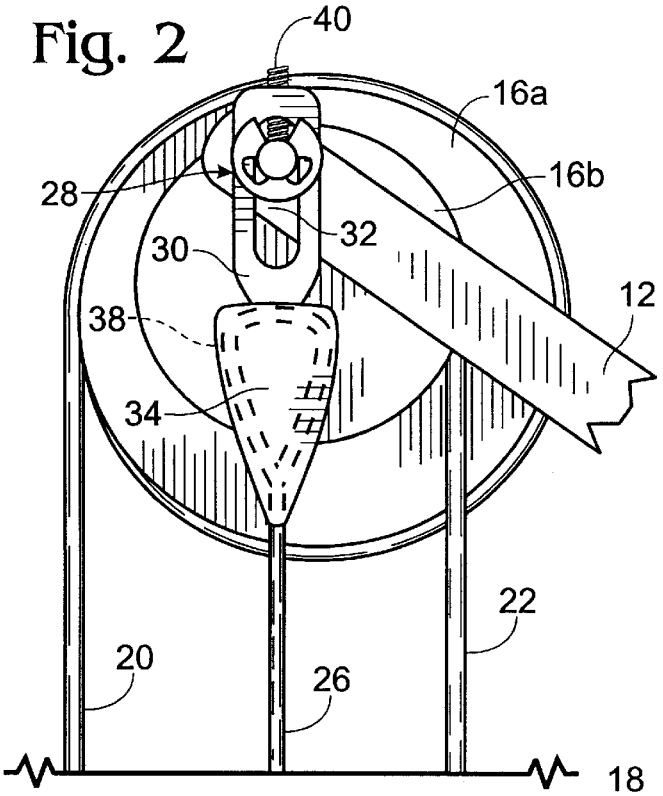
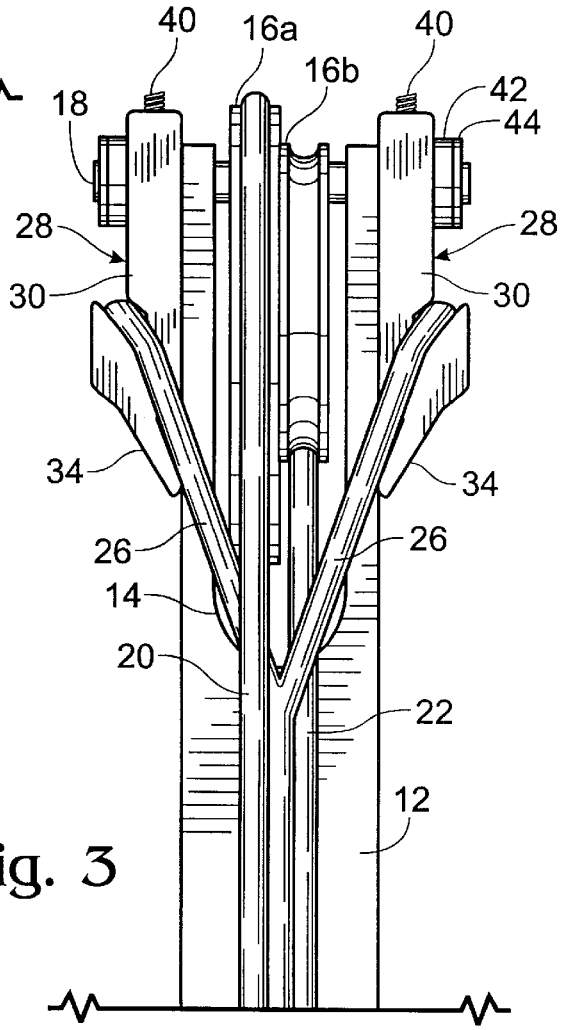
Fig. 3

ARCHERY BOW CABLE ADJUSTER

BACKGROUND AND SUMMARY OF THE INVENTION

This invention relates to a cable adjuster which attaches the ends of a compound archery bow cable to the bow limbs, and in particular to a cable adjuster which allows the length of each leg of a cable having split ends to be adjusted independently.

While compound archery bows are able to generate much more power than conventional bows, they need to be finely tuned to achieve maximum accuracy and repeatability. The theory of how to tune compound archery bows is old and is described in detail in a 1976 book by Emery J. Loisell entitled *Doctor Your Own Compound Bow*. Tuning a compound archery bow requires adjusting the length of the bow cables, which in the case of a bow having split cable ends requires being able to independently adjust the length of four different cable segments.

Cable adjusters for compound archery bows are well known in the prior art. A typical prior art cable adjuster is shown in Wenzel, et al., U.S. Pat. No. 5,606,963. However, Wenzel et al. do not disclose a cable adjuster that would work with a split end cable. Mitchell et al., U.S. Pat. No. 5,381,771, do disclose a cable adjuster for split end cables. The cable adjuster of Mitchell et al. is complex to make and use and it is aesthetically unpleasing. In addition, it would tend to cause twisting of the bow limbs. Thus, the cable adjuster of Mitchell et al. has not been widely used by archers.

The subject invention provides a simple cable adjuster which permits accurate, easy adjustment of all four cable ends of a compound archery bow by providing an elongate body having a medial slot. The slot is dimensioned to fit over the projecting ends of the pin which journals the bow cams and allows the body to slide up and down on the pin. One body fits over the pin at each side of the bow limb. Each body is secured on the pin by a retainer which is attached to the end of the pin.

A button, which is attached to the lower end of each body, releasably engages a loop formed in the extremity of the cable end. An adjustment device extends through the top end of the body and into the slot where it contacts the pin. The adjustment device, which preferably is a set screw, is movable into and out of the slot. Movement of the adjustment device into the slot moves the body outwardly on the bow limb and effectively decreases the length of the associated cable end, and moving it out of the slot moves the body inwardly on the bow limb and effectively increases the length of the cable end.

A notch is formed between the body and the button which seats the cable loop on the cable adjuster. The notch and button are oriented at an angle with respect to the body so that when a force is applied to the cable, the elongate axis of the body remains normal to the axis of the pin so that the cable adjuster can rotate freely on the pin without binding.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 1 is a side elevation view of a compound archery bow with the cable adjusters of the subject invention.

FIG. 2 is a side elevation view, at an enlarged scale, showing the cable adjusters on the archery bow.

FIG. 3 is an end elevation view showing a cable adjuster on the bow.

FIG. 4 is a side elevation view of the cable adjuster alone, with a cable end attached.

FIG. 5 is an end elevation view of the cable adjuster alone with a cable end attached.

DETAILED DESCRIPTION OF A PREFERRED EMBODIMENT

Referring now to FIGS. 1–3 of the drawings, a compound archery bow comprises a riser 10 with flexible limbs 12 at each end. Each limb 12 has a medial notch 14, FIG. 3, which contains a pair of rotatably mounted cams 16. The cams 16 are journaled on an elongate pin 18 which extends through openings in the limb. A larger cam 16*a* has one end of the bow string 20 attached to and partially wrapped around it. The opposite end of the bow string is partially wrapped around the larger cam 16*a* mounted in the opposite limb. Each smaller cam 16*b* has one end of one cable 22 attached to and partially wrapped around it. The other end of each cable is attached to the opposite limb. In the embodiment illustrated, the end of the cable that is attached to the limb is split into two end pieces 26 with one end piece being attached to the limb on each side of the notch 14. There are two cables 22 with one being attached to each smaller cam 16*b* and they cross in the middle of the bow. The cams 16 are eccentrically mounted on the pins 18. The cables and eccentrically mounted cams provide an increase in the energy that the bow can produce for a given draw force. The shape and eccentricity of the cams can be tailored to give the desired draw/force curve. A cable guard 24 holds the cables 22 off to one side of the center line of the bow where they are out of the way of the bow string 20.

Referring now also to FIGS. 4–5, the cable adjusters 28 of the subject invention connect the cable end pieces 26 to the bow limbs 12. One cable adjuster is located on each side of each bow limb and connects each end piece 26 to the respective bow limb. Each cable adjuster comprises a body 30 that has an elongate medial slot 32. The slot is slightly wider than the diameter of the pin 18, and a length which is several times larger than the diameter of the pin. Located in the upper end of the body 30 is a threaded hole (not shown). A set screw 40 extends through the threaded hole and into the slot 32. The pin 18 extends outwardly from each side of the bow limb and through the slot 32 in one of the cable adjusters. A washer 42 fits over the pin and against the side of each body 30 to hold it snugly against the bow limb but still allow it to slide along the pin between the bottom of the slot and the end of the set screw 40 that extends into the slot. A keeper 44 snaps into a groove (not shown) at each end of the pin to hold the washer and cable adjuster in place on the pin.

Located at the lower end of the body 30 is a button 34 which is generally triangular. The center line of the button is oriented at an angle with respect to the center line of the body and a notch 36 is formed between the body and the button. A loop 38 is formed in each end piece 26 of the cable 22 and the notch and button are configured such that the loop 38 can be placed over the button and yet when a force is applied to the cable the loop seats in the notch and the button prevents it from becoming dislodged.

The angle of the button relative to the body is configured so that when a force applied to the cable 22 is transmitted through the cable ends 26 to the cable adjusters, the cable adjusters are pulled in a direction which is normal to the center line of the pin 18. Since the center line of the pin 18 is normal to the longitudinal center line of the body 30, this allows the body to rotate freely on the pin without binding.

When the cable adjusters of the subject invention are installed on a bow, the length of all four cable ends can be adjusted independently. By threading the set screw of one of the cable adjusters inwardly into its associated body, it pushes against the pin and moves the body outwardly thereby effectively shortening the length of the cable end. By threading the set screw out of the body, it allows the tension in the cable to pull the body inwardly to effectively extend the length of the cable end. In operation, a bow string with the cable adjusters of the subject invention can easily be tuned to provide cam synchronization, set the cable lengths and to prevent torquing of the bow limbs.

Preventing torquing is normally accomplished first. Torquing occurs because the cable guide 24 deflects the cables which causes them to pull on the smaller cams 16*b* at an angle. This in turn torques the bow limbs which causes the larger cams 16*a* to be cocked so that the bow string is not aligned with them. Torquing reduces the life of the limbs and the pin bushings. In addition, it causes side movement of the bow string. Torquing is eliminated by adjusting one of the cable adjusters on one limb relative to the other cable adjuster on the same limb until the bow string appears to be aligned with the cam 16*a* when it is relaxed and at its full draw. This procedure is then repeated for the other limb.

Synchronization is achieved after torquing has been eliminated. Synchronization is accomplished by adjusting both cable adjusters at one end and/or the other end until the cable is wound into the smaller cams 16*b* the same amount at both ends of the bow. A bow that is out of synchronization will shoot arrows at a higher or lower arch depending on the amount of draw. To obtain synchronization, a group of arrows are shot at the same sight setting at various draw lengths and the amount of variation of where the arrows shot at different draw lengths strike the target is noted. Both cable adjusters at one end of the bow are then adjusted one way or the other and another group of arrows are shot. It then is noted whether there is a greater or lesser difference between the arrows of the first group and the second group and, based on the result, further adjustments are made to reduce this distance. Eventually, the adjustment that minimizes the amount of separation between the arrows will be achieved and the cams are synchronized.

Finally, after the other adjustments have been made, draw length can be adjusted a small amount by shortening or lengthening all four cable adjusters by the same amount until the desired draw length is achieved.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A cable adjuster for a compound archery bow of the type having opposed limbs with medial notches, a pair of concentrically offset cams rotatably mounted in each notch on a pin and a pair of cables, one end of each cable being attached to one of said cams on one of said limbs, and the other end being split into two cable ends with one cable end being attached to the extremity of the opposed limb on each side of the notch, said cable adjuster comprising:

(a) a body having a slot defined medially therein;

(b) the pin being configured to project outwardly from the limb on each side thereof and extend through said slot in one of said cable adjusters;

(c) a retainer located on each extremity of the pin which secures said body rotatably on the pin;

(d) a button attached to said body at one end thereof which releasably engages a loop formed in the extremity of each cable end; and (e) an adjustment device which extends into said slot in the end of said body opposite the end attached to said button and contacts said pin, said adjusting device being movable into and out of said slot, wherein movement of said adjustment device into said slot causes the cable associated therewith to be moved toward the end of the limb and movement of said adjustment device out of said slot causes the cable end associated therewith to be moved away from the end of the limb.

2. The cable adjuster of claim 1 wherein said cable adjuster includes a notch between said body and said button which said loop seats in.

3. The cable adjuster of claim 2 wherein said body has an elongate axis which is oriented normal to the axis of said pin and said button and said notch are oriented at an angle with respect to the axis of said body such that when a force is applied to said cable, said cable does not urge said body out of its normal alignment with said pin.

4. The cable adjuster of claim 1 wherein said body has a threaded opening in the end thereof opposite said button and said adjustment device comprises a set screw which fits in said opening.

* * * * *